US005160589A

United States Patent [19]

Gionfriddo

[11] Patent Number: 5,160,589

[45] Date of Patent: Nov. 3, 1992

[54] PROCEDURE FOR THE REDUCTION OF THE CROSS-SECTION OF A WIRE

[76] Inventor: Michelangelo Gionfriddo, 57 Via Fusinato, Padua, Italy

[21] Appl. No.: 713,373

[22] Filed: Jun. 13, 1991

[51] Int. Cl.[5] ..... C25F 3/06

[52] U.S. Cl. ..... 204/129.1; 204/129.55; 204/129.95; 204/141.5

[58] Field of Search ..... 204/141.5, 129.1, 129.55, 204/129.9, 129.95

[56] References Cited

U.S. PATENT DOCUMENTS 2,803,596 8/1957 Brown ..... 204/141.5 X
3,287,238 11/1966 Latawiec et al. ..... 204/141.5 X
3,740,324 6/1973 Lesher ..... 204/129.1 X
3,900,376 8/1975 Copsey et al. ..... 204/141.5
4,375,396 3/1983 Beggs et al. ..... 204/129.55

*Primary Examiner*—Donald R. Valentine
*Attorney, Agent, or Firm*—Dowell & Dowell

[57] ABSTRACT

A new procedure for reduction of the cross-section of a wire used in orthodontics for displacement of teeth in which the wire is partially immersed in the area of the portion of the wire to be reduced into a titanium tray containing an 85% orthophosphoric acid solution and the tray is connected to a negative battery pole while the wire is connected to the positive pole of the battery.

3 Claims, 1 Drawing Sheet

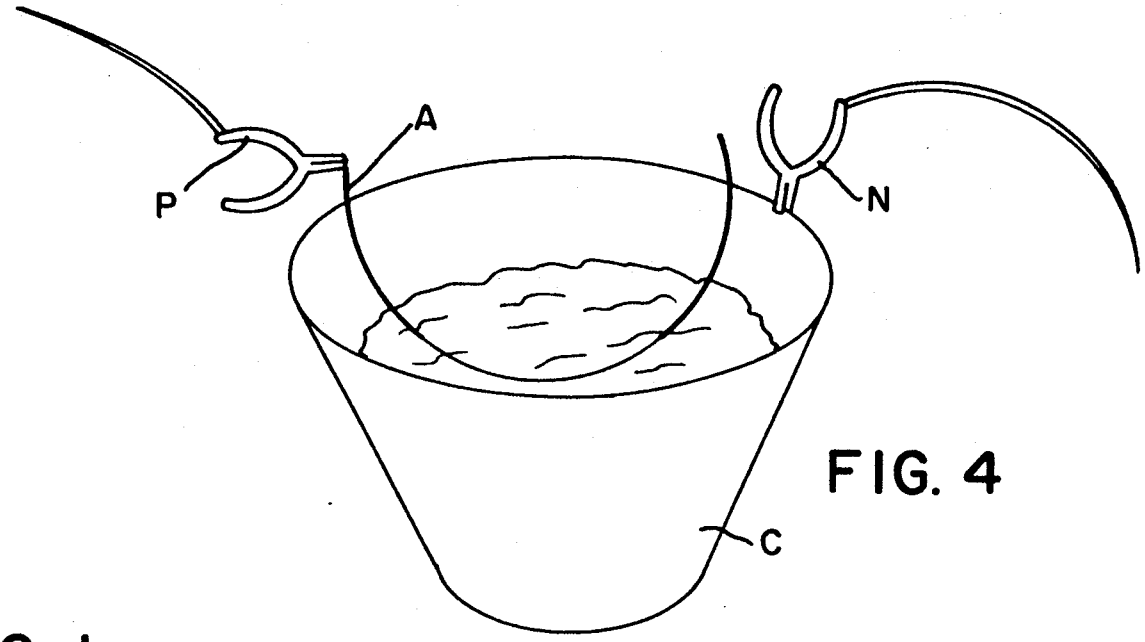
FIG. 4
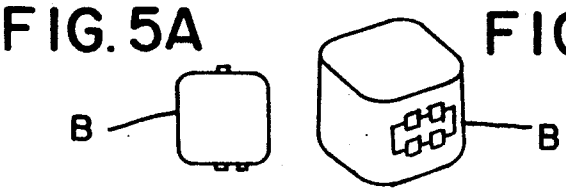
FIG. 5A
FIG. 5B
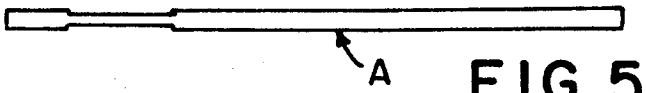
FIG. 5C
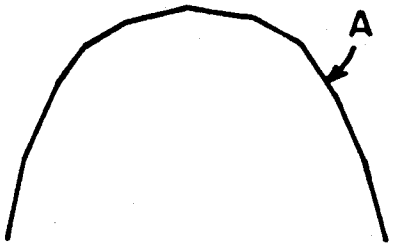
FIG. 2
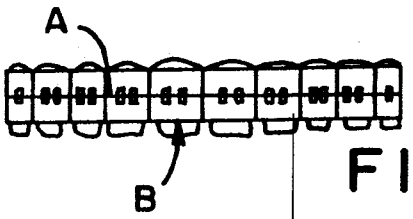
FIG. 1
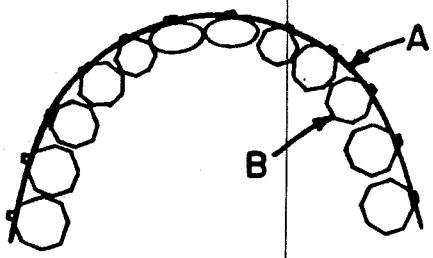
FIG. 3

PROCEDURE FOR THE REDUCTION OF THE CROSS-SECTION OF A WIRE

BACKGROUND OF THE INVENTION

1. Field of the Invention

This invention relates to the preparation and shaping of wires used in orthodontics.

2. History of the Related Art

In the field of dental care, in particular in relation to their displacement, an arch-shaped wire is used, which, by anchoring onto the rear teeth (molars), presses against the front teeth causing them to be gradually drawn inwards. For each patient it is necessary to prepare and press into shape an appropriate wire arch which will be formed according to the state of the teeth and of the desired final effect. The arch is placed in front of the teeth, both on the upper and lower arcade.

A plate, bracket or crown will be inserted into place on each tooth with a special attachment to allow insertion of a wire made of resilient steel (prepared according to the patient's specific defect) which will be inserted into the crown attachments in order to establish the controlled displacement of the teeth.

Most patients require use of variable sectioned arches in proximity to the various teeth to be displaced. In fact, in order to optimize the force acting on each single tooth it is appropriate to reduce the section in a few points of the arch. The combined forces acting together with the particular configuration of the arch will determine a greater pulling force to be applied to the front teeth (incisors) than that applied to the side teeth (canines and molars).

SUMMARY OF THE INVENTION

The invention consists of a new method for reducing the wire section of the arch. The wire is normally produced in a constant, rectangular cross-section. It is thus shaped to form an arch so as to properly fit the form of the patient's mouth. Having carried out the shaping process, the arch is then immersed in a galvanic solution in a titanium metal tray to which the negative pole of the power supply is connected.

The positive pole is thereby connected to the arch itself, which is then partially immersed, only for the specific portion to be reduced, into a solution containing orthophosphoric acid. By applying a direct current source (about 3–4 Amps) to the system, the cross-section of the arch will very soon start the gradual, constant reduction process. The section will however still remain rectangular.

BRIEF DESCRIPTION OF THE DRAWINGS

FIG. 1 is a front plan illustrational view of a patient's teeth having orthodontic brackets secured thereto which are connected by the arch wire of the present invention.

FIG. 2 is a bottom plan view of the arch wire of FIG. 1.

FIG. 3 is a bottom plan view of the brackets and arch wire of FIG. 1.

FIG. 4 is a perspective illustrational view of the titanium tray showing the wire and the electrical connections to the wire and tray utilized in accordance with the teachings of the present invention.

FIGS. 5A and 5B are top plan and front perspective views, respectively, of the orthodontic bracket.

FIG. 5C is an illustrational view showing an arch wire having a reduced segment formed in accordance with the teachings of the present invention.

DESCRIPTION OF THE PREFERRED EMBODIMENT

With continued reference to the drawings, the invention is directed to a method for reducing segments or portions of the arch wire (A) utilized to connect brackets (B) in correcting deformities through orthodontic procedures. The arch wire (A) is normally produced in a continuous rectangular cross-section and is shaped by the practitioner to form an arch so as to properly conform to the patient's mouth. Once the preliminary shape has been made, the arch wire is immersed in a galvanic solution in a titanium metal tray (C) to which the negative pole of an electrical power supply source is connected, as is shown at (N) in FIG. 4A. The positive pole or terminal of the electrical power source (not shown) is connected to the arch wire as shown at (P). Only the specific portion of the wire that is to be reduced is dipped into the solution, which solution contains orthophosphoric acid in concentrated form up to approximately 85%. By applying a direct current source of approximately 3–4 Amps between the poles, the cross-section of the arch wire will gradually be reduced, however, the section will remain rectangular.

This process can also be used with lower time of application and lower currents for the cleaning of used arches for removal of fats and traces of foodstuffs. Furthermore, by connecting the positive and negative poles to the two ends of the arch an applying a very weak direct current for a very short time, it is possible to obtain a redistribution of the electrons after having bent the arch.

After having carried out the reduction treatment of the arch in orthophosphoric acid, the arch is then immersed into a neutralizer solution, like for example Sodium Carbonate.

As a non-limiting example we illustrate a practical realization of the invention, where in FIG. 1 the arch wire (A) is shown applied onto the rings or brackets (B) which are set onto the teeth. In FIG. 2 the arch-shaped wire is shown. In FIG. 3 we show a bottom view of the arch wire (A) mounted onto the crowns (B). In FIG. 4 we have illustrated the arch wire (A) immersed into the circular titanium tray (C) which contains an 85% orthophosphoric acid solution into which the arch wire is immersed for reduction. The negative pole (N) of the power supply is connected directly to the metal tray (C) whereas the positive pole (P) is connected to the arch wire.

These schematic modalities are sufficient explanation for an expert technician to carry out the invention. For this purpose, in actual application there may be some variation to the general layout, without compromising the substance of the innovative concept.

Therefore with reference to the above description and the annexed drawing, we express the following.

I claim:

1. A method for selectively reducing the cross-sectional dimension of portions of a wire used to join orthodontic brackets for displacement of teeth using an electrical power source having positive and negative poles comprising the steps of: connecting the wire to the positive pole, immersing the portion of the wire to be reduced into a titanium container containing a solution of highly concentrated orthophosphoric acid, connecting the negative pole of the electrical power source to the container, and applying a low intensity electric current between the two poles.

2. The method for the reduction of a wire for displacement of teeth, as per claim 1, wherein, after reduction, the wire is immersed into a neutralizer solution.

3. The method for the reduction of a wire for displacement of teeth, as per claim 1, wherein by application of a lower intensity electric current organic residues are removed from the wire within the solution.

* * * * *